United States Patent [19]

Hunter

[11] Patent Number: 4,848,440

[45] Date of Patent: Jul. 18, 1989

[54] MOLD CORE SETTER WITH IMPROVED VACUUM SYSTEM

[75] Inventor: William A. Hunter, Inverness, Ill.

[73] Assignee: Hunter Automated Machinery Corporation, Schaumburg, Ill.

[21] Appl. No.: 684,955

[22] Filed: Dec. 21, 1984

[51] Int. Cl.[4] ..... B22D 33/00

[52] U.S. Cl. ..... 164/253; 164/340; 164/397

[58] Field of Search ..... 164/30, 137, 253, 340, 164/370, 397; 294/64.2, 64.3

[56] References Cited

U.S. PATENT DOCUMENTS

| | | | |
|---|---|---|---|
| 3,424,229 | 1/1969 | Gunnergaard-Poulsen | 164/340 |
| 3,716,307 | 2/1973 | Hansen | 294/64.2 |
| 3,959,864 | 6/1976 | Tell | 29/156.4 R |
| 4,073,602 | 2/1978 | Cagle | 294/64.2 |
| 4,079,748 | 2/1977 | Gunnergaard | 164/137 |
| 4,079,774 | 3/1978 | Gunnergaard et al. | 164/137 |

FOREIGN PATENT DOCUMENTS

| | | | |
|---|---|---|---|
| 57-159237 | 3/1981 | Japan . | |
| 197808 | 8/1978 | Switzerland | 164/340 |
| 603275 | 8/1978 | Switzerland . | |

OTHER PUBLICATIONS

Advertisement—"Beardsley & Piper".

Advertisement—"New Product—Coresetters Developed for Automatic Molding Machines", Modern Casting, May 1984, p. 45.

*Primary Examiner*—Richard K. Seidel

*Attorney, Agent, or Firm*—Leydig, Voit & Mayer

[57] ABSTRACT

An automatic core setting machine having a movable mask with pockets for holding foundry cores until the mask is brought into face-to-face abutment with a mold, and a vacuum system comprising a body member integral with the pocketed mask and defining an interior suction chamber, the body member comprising a first wall having means defining a plurality of inlet ports terminating on the interior surface of the first wall in a plurality of injector nozzles, a second wall parallel to the first wall and having means defining a plurality of outlet ports terminating on the interior surface of the second wall in a plurality of ejector nozzles, each of the plurality of outlet ports being axially aligned with one of the plurality of inlet ports, and side walls rigidly connecting the first wall and the second wall and defining a space therebetween; means defining a suction opening through at least one of the side walls, the suction opening communicating with the interior suction chamber of the body member; means for connecting the side wall suction opening to the core pockets of the mask; a pressurized air source; and means for injecting pressurized air into the plurality of inlet ports.

2 Claims, 3 Drawing Sheets

MOLD CORE SETTER WITH IMPROVED VACUUM SYSTEM

TECHNICAL FIELD

The present invention relates generally to mold core setting machines for use in foundries, and, more particularly, to such a machine having an improved vacuum system.

BACKGROUND ART

An automatic core setting machine is disclosed in Hunter U.S. patent application, Ser. No. 680,478, filed Dec. 11, 1984, now U.S. Pat. No. 4,590,982. In that machine, the cores are carried in pockets in a mask from a tilted receiving position to a horizontal position with the cores facing downward. During movement of the mask, the cores are held in the mask by applying suction to the core pockets by means of a vacuum pump. Due to sand particles loosened from the sand molds and drawn into the vacuum system, however, previously used vacuum pumps have experienced clogging, premature wear and failure.

SUMMARY OF THE INVENTION

It is a primary object of the present invention to provide an improved vacuum system which is not operationally affected by loose sand particles being drawn into it.

It is another object of this invention to provide such an improved vacuum system which can be economically manufactured, and yet which provides an adequate vacuum for use with an automatic core setting machine.

A further object of this invention is to provide a vacuum system with means for blowing loose sand particles from the surface and mold cavities of the sand molds prior to setting the cores in the cavities.

Other objects and advantages of the invention will be apparent from the following detailed description.

In accordance with the present invention, an automatic core setting machine, having a movable mask with pockets for holding foundry cores until the mask is brought into face-to-face abutment with a mold, is provided with a vacuum system comprising a body member fastened to said pocketed mask and defining an interior suction chamber, said body member comprising a first wall having means defining a plurality of inlet ports terminating on the interior surface of said first wall in a plurality of injector nozzles, a second wall spaced from and opposing said first wall and having means defining a plurality of outlet ports terminating on the interior surface of said second wall in a plurality of ejector nozzles, each of said plurality of outlet ports being axially aligned with one of said plurality of inlet ports, and side walls rigidly connecting said first wall and said second wall and defining a space therebetween; means defining a suction opening through at least one of said side walls, said suction opening communicating with said interior suction chamber of said body member; means for connecting said side wall suction opening to said core pockets of said mask; a pressurized air source; and means for injecting pressurized air into said plurality of inlet ports.

DESCRIPTION OF THE PREFERRED EMBODIMENT

While the invention will be described in connection with certain preferred embodiments, it will be understood that it is not intended to limit the invention to these particular embodiments. On the contrary, it is intended to cover all alternatives, modifications, and equivalents included within the spirit and scope of the invention as defined by the appended claims.

Figure 1:
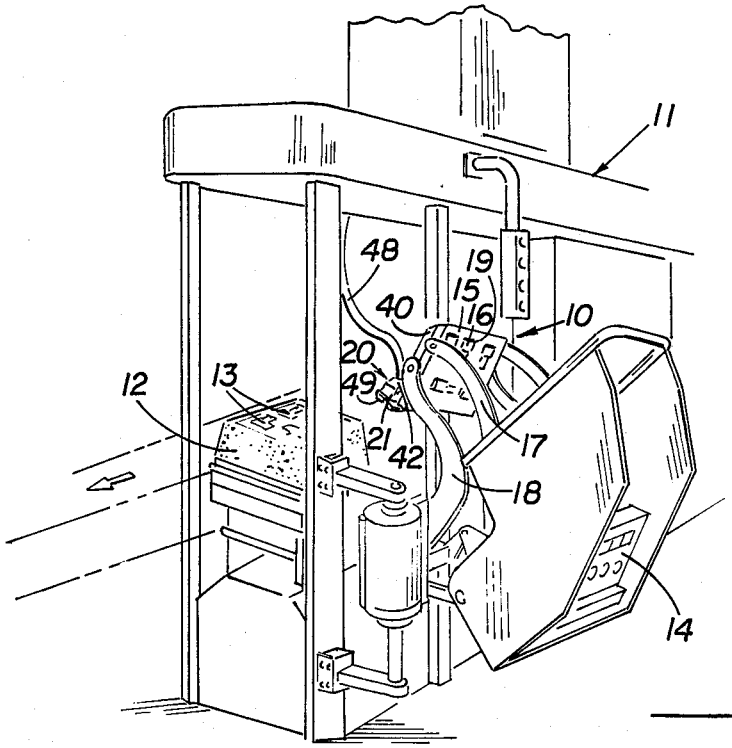
FIG. 1 is a perspective view showing the automatic core setting machine equipped with the vacuum system of the present invention and part of the molding machine.

Turning now to the drawings and referring first to FIG. 1, there is shown an automatic core setting machine 10 equipped with a vacuum system 20 in conjunction with an automated mold handling system having an automatic match plate molding machine 11 for making green sand molds 12.

In operation, the automated mold having system conveys the molds 12 past the core setting machine 10. It will be noted that each mold is formed with a plurality (e.g., five) of upwardly opening mold cavities 13. As each mold is moved by the conveyancing system (not shown in the drawings), it pauses adjacent to the core setting machine 10. The core setting machine, operated from control station 14, is then manipulated so that the mask 15 is swung from an initial loading position (shown in phantom in FIG. 4 at A) by arms 17, 18 to a core-setting position in abutting face-to-face relation (shown in phantom in FIG. 4 at B) with the mold 12. Foundry cores 16, carried by pockets 19 in the mask 15, are then set in the cavities 13 of the mold 12, and the mask is lifted away from the mold by arms 17, 18 and returned to its initial position for reloading with new cores.

Figure 3:
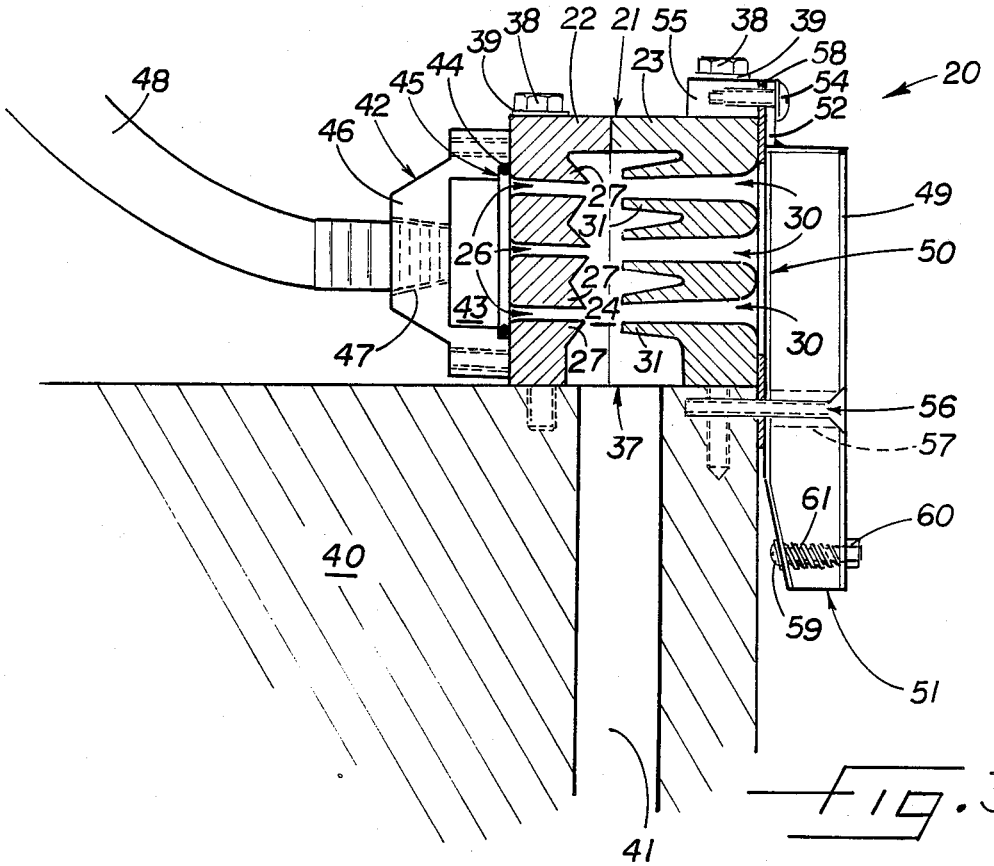
FIG. 3 is a sectional side view of the vacuum system of the present invention.
Figure 2:
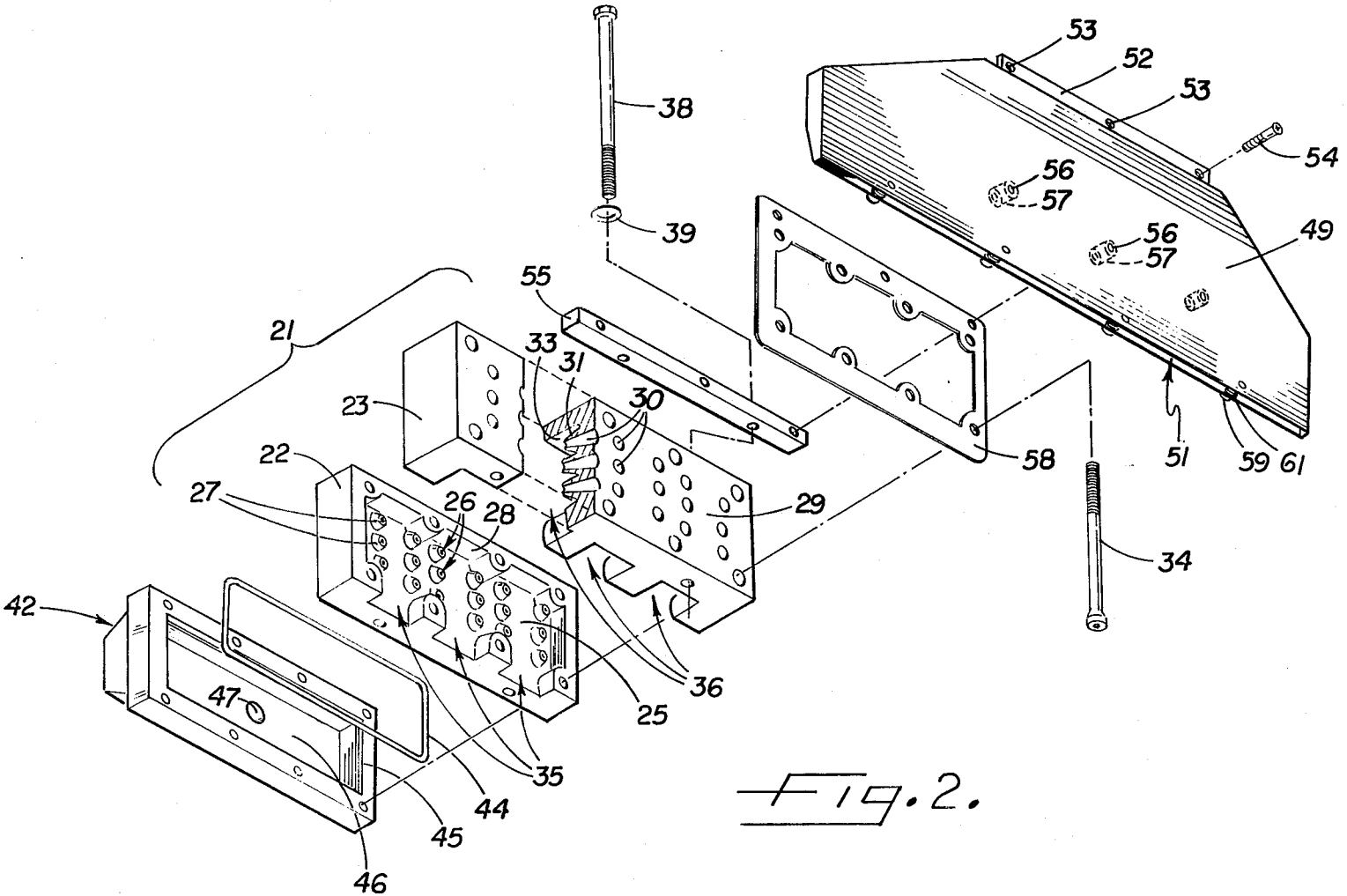
FIG. 2 is an exploded perspective view of the vacuum system of the present invention.

In accordance with the present invention, the core setting machine 10 is provided with a vacuum system 20 for providing suction to the core pockets 19 of the mask 15, thereby enabling foundry cores 16 to be held therein as the mask is swung from its initial loading position to its core-setting position. The vacuum system 20 of the present invention (as illustrated in FIGS. 2 and 3) comprises a main body member 21 having first and second body portions 22, 23 which define a suction chamber 24 therebetween. These body portions can be made of moldable polymeric materials (e.g., polyurethane) or can be made of metal.

First body portion 22 comprises a first wall 25 having a flat exterior surface perforated by a plurality of inlet ports 26. The inlet ports extend through first wall 25 and terminate on the inner surface thereof in a plurality of cone-shaped injector nozzles 27. A first ledge 28 extends along the periphery of the inner surface of first wall 25, thereby defining side wall portions for body member 21. It will be noted that first ledge 28 extends a greater longitudinal distance from the surface of first wall 25 than do the injector nozzles 27.

Second body portion 23 is substantially the same as first body portion 22. It has a second wall 29 with a flat exterior surface which is perforated by a plurality of outlet ports 30 which extend through second wall 29 and terminate on the inner surface thereof in a plurality of cone-shaped ejector nozzles 31. Second ledge 33 circumscribes the inner edge of second wall 29, as does first ledge 28 on first wall 25.

First body portion 22 and second body portion 23 are attached to one another by means of bolts 34 which extend through axially aligned longitudinal bores in ledges 28, 33, and have nuts (not shown) attached to the protruding end thereby forming body member 21. When first body section 22 and second body section 23 are bolted together, each inlet port 26, and its corresponding injector nozzle 27, is axially aligned with an outlet port 30, and its corresponding ejector nozzle 31, thereby providing a straight path by which pressurized air can pass through body member 21. Furthermore, spaces 35 and 36 are made in first ledge 28 and second ledge 33, thereby creating a transverse suction opening 37 communicating with suction chamber 24 of body member 21. Body member 21 is then attached to the mounting plate 40 of core setting machine 10 with screws 38 and washers 39 so that suction opening 37 is aligned with duct 41, thereby providing a communication channel between the suction chamber 24 and the core pockets 19 of mask 15.

As shown in FIGS. 2 and 3, the vacuum device of the present invention also comprises an intake manifold 42. This manifold entails an oblong member forming an intake hole on one side and an open manifold chamber on the other side. The open side of intake manifold 42 is placed in abutting relation to the flat exterior surface of first wall 25 of first body portion 22, thereby defining an injection chamber 43. Intake manifold 42 is attached to first body portion 22 by way of the same bolts 34 used to attach body portions 22 and 23 to one another, and an O-ring 44 lies in peripheral groove 45 of the manifold so as to create a seal therebetween.

Wall 46 of the intake manifold forms the intake hole 47 for receiving the nozzle of a hose 48 which carries pressurized air from a pressurized air source (not shown). It will be appreciated that the injection chamber 43 encompasses all of the inlet ports 26 of the first body portion 22, so that pressurized air entering manifold 42 and injection chamber 43 enters body member 21 through all of the inlet ports 26.

Figure 4:
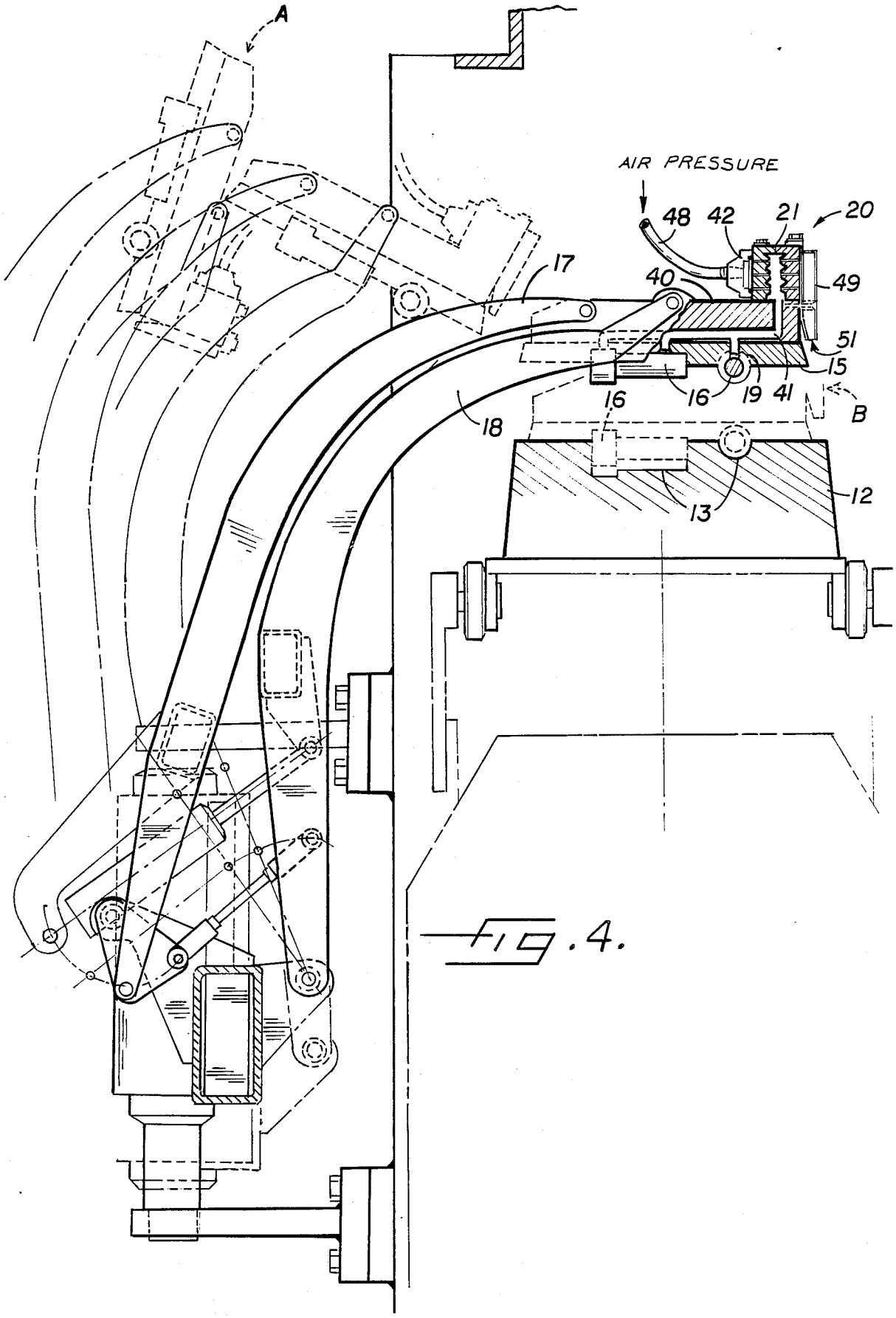
FIG. 4 is an enlarged fragmentary cross-section of the automatic core setting machine equipped with the vacuum system of the present invention showing the operational movement of the arms and mask.

Foundry cores 16 are located into the pockets 19 of mask 15 while the core setting machine is in its initial loading position (shown in phantom in FIG. 4 at A). As the mask is swung by arms 17, 18 to its core-setting position (shown in phantom in FIG. 4 at B), it is turned so that the cores 16 are brought into a downwardly facing position for downward insertion into mold 12. Consequently, suction must be applied to the core pockets 19 of mask 15 so that the cores 16 are maintained therein. To create this vacuum, pressurized air (e.g., 50 psi) is passed through hose 48 to intake manifold 42, whereupon it enters body member 21 as previously described. The air streams from injector nozzles 27 jet across suction chamber 24 and into ejector nozzles 31, which lie in axial alignment with injector nozzles 27, and exits body member 21 through outlet ports 30.

It will be appreciated that the jetting of the pressurized air from injector nozzles 27 to ejector nozzles 31 aspirates air from the suction chamber 24, thereby creating a vacuum in chamber 24. Consequently, air in duct 41 is drawn into suction chamber 24 and is subsequently exhausted through ejector nozzles 31. Since the ends of duct 41 (i.e., the pockets 19 of mask 15) are blocked by cores 16, air cannot be drawn therethrough, and a vacuum is created in duct 41, thereby maintaining the cores in the pockets. It has been found that by using a source of air pressurized to 50 psi, the vacuum device of the present invention has been able to draw a vacuum on the order of 15 inches of mercury (381 mm. Hg) which is adequate to hold the cores in the pockets. A pure vacuum has a value of 29.92 inches of mercury (760 mm. Hg).

It will further be apparent that this vacuum system is not operationally affected by the intake of loose sand particles. While loose sand particles cause clogging, wear and failure in conventional vacuum pumps, loose sand drawn into the suction chamber 24 of the present invention is either exhausted through outlet ports 30 or collected at the bases of ejector nozzles 31. Regardless of whether the particles are collected or exhausted, the operation of the vacuum system is not affected. Accordingly, it will be appreciated that the vacuum system of the present invention is ideal for use with a core setting machine which constantly comes into contact with sand molds from which sand particles may be loosened.

In accordance with another important aspect of the present invention, the body member 21 has attached thereto, in abutting relation with the flat exterior face of body portion 23, an exhaust manifold 49. This exhaust manifold, which is made of sheet metal, comprises a hollow member having an inlet 50, through which air enters upon leaving outlet ports 30 of body member 21, and an exhaust orifice 51 for exhausting this air from manifold 49. This manifold further comprises a lip 52 having several holes 53 for receiving bolts 54. This lip 52 serves as a means by which the exhaust manifold 49 is rigidly attached to body member 21. As shown in FIGS. 2 and 3, the exhaust manifold 49 is secured to an attachment bar 55 which is bolted to the top of second body portion 23, and is further secured through holes 56 to the mounting plate 40 of core setting machine 10. Holes 56 having bolt sleeves 57 integral therewith for preventing the bolts (not shown) extending therethrough from deforming the sides of the manifold 49 as they are tightened into the mounting plate 40. A gasket 58 placed between second body portion 23 and exhaust manifold 49 seals the junction of those two members.

As illustrated in FIG. 2, the exhaust manifold 49 is equal in width at its top to body member 21, but tapers outwardly therefrom so that the exhaust orifice 51 has a width corresponding to that of the sand molds 12. Consequently, as the core setting machine swing mask 15 from its loading position to its core-setting position, air exhausted from the body member 21 of the vacuum device is directed downwardly by exhaust manifold 49, thereby blowing loose sand particles out of the cavities 13 and off the surface of sand mold 12.

The exhaust manifold 49 also has a series of pinching mechanisms near the exhaust orifice 51. Each of these mechanisms comprises a threaded bolt 59, a nut 60 and a spring 61. The bolt extends through holes in both sides of manifold, and the nut is threaded thereon so that it lies on the outside of the manifold. Consequently, the size of the exhaust orifice 51 can be decreased by tightening the nut 60. This decreasing of the orifice size causes the exhausting air to flow at an increased velocity. The spring 61 is positioned on the shaft of bolt 59 in the interior of manifold 49, and is designed such that it will exert a force on the inside of manifold walls large enough to expand the size of exhaust orifice 51 as nut 60 is loosened. Therefore, by loosening and tightening nut 60, the orifice size can be increased and decreased.

As can be seen from the foregoing detailed description, this invention provides an improved vacuum system for use with an automatic core setting machine because it is not operationally affected by the intake of sand particles. This vacuum system is economical to manufacture, and yet provides an adequate vacuum for suspending the foundry cores in the pockets of the core setting machine mask.

What is claimed is:

1. An automatic core setting machine having a movable mask with pockets for holding foundry cores until the mask is brought into face-to-face abutment with a mold, which is provided with a vacuum system, the vacuum system comprising:

a body member fastened to said pocketed mask and defining an interior suction chamber, said body member comprising a first wall having means defining a plurality of inlet ports terminating on the interior surface of said first wall in a plurality of injector nozzles, a second wall spaced from and opposing said first wall and having means defining a plurality of outlet ports terminating on the interior surface of said wall in a plurality of ejector nozzles, each of said plurality of outlet ports being axially aligned with one of said plurality of inlet ports, and side walls rigidly connecting said first wall and said second wall and defining a space therebetween;

means defining a suction opening through at least one of said side walls, said suction opening communicating with said interior suction chamber of said body member;

means for connecting said side wall suction opening to said core pockets of said mask;

a pressurized air source;

means for injecting pressurized air into said plurality of inlet ports, and an exhaust manifold having an exhaust orifice at one end for directing gas exiting said body member by way of said plurality of outlet ports across said mold as the mask and mold are brought into face-to-face abutment.

2. The vacuum system of claim 1 wherein the exhaust orifice of the exhaust manifold further comprises pinching means for adjusting the size of the exhaust orifice.

* * * * *

UNITED STATES PATENT AND TRADEMARK OFFICE

CERTIFICATE OF CORRECTION

PATENT NO. : 4,848,440

DATED : July 18, 1989

INVENTOR(S) : William A. Hunter

It is certified that error appears in the above-identified patent and that said Letters Patent is hereby corrected as shown below:

Col. 4, line 32, "This" should be -- The --.

Col. 4, line 50, "swing" should be -- swings --.

Col. 6, line 1, before "wall" insert -- second --.

Signed and Sealed this

Twenty-first Day of January, 1992

*Attest:*

HARRY F. MANBECK, JR.

*Attesting Officer*

*Commissioner of Patents and Trademarks*